United States Patent [19]

Chiba et al.

[11] Patent Number: 4,932,388

[45] Date of Patent: Jun. 12, 1990

[54] ROTARY POSITION DETECTOR FOR INTERNAL COMBUSTION ENGINE

[75] Inventors: Masaaki Chiba; Shigemi Murata, both of Hyogo, Japan

[73] Assignee: Mitsubishi Denki Kabushiki Kaisha, Tokyo, Japan

[21] Appl. No.: 261,856

[22] Filed: Oct. 25, 1988

[30] Foreign Application Priority Data

Nov. 9, 1987 [JP] Japan ..... 62-282553

[51] Int. Cl.[5] ..... F02P 7/073

[52] U.S. Cl. ..... 123/613; 123/414; 73/117.3

[58] Field of Search ..... 123/414, 476, 612, 613; 73/116, 117.3, 488; 324/168, 169

[56] References Cited

U.S. PATENT DOCUMENTS

| | | | |
|---|---|---|---|
| 3,807,378 | 4/1974 | Wernet, Jr. | 123/613 |
| 3,931,804 | 1/1976 | Bowen | 123/613 |
| 4,000,724 | 1/1977 | Fowler | 123/613 X |
| 4,122,814 | 10/1978 | Ford | 123/613 X |
| 4,386,270 | 5/1983 | Ezekiel | 250/231 SE |
| 4,686,953 | 8/1987 | Brown | 123/606 |
| 4,718,396 | 1/1988 | Shimada et al. | 123/476 X |
| 4,773,381 | 9/1988 | Koshida | 123/613 X |

FOREIGN PATENT DOCUMENTS

| | | |
|---|---|---|
| 0003288 | 8/1979 | European Pat. Off. . |
| 2266889 | 10/1975 | France . |

*Primary Examiner*—Willis R. Wolfe

*Attorney, Agent, or Firm*—Sughrue, Mion, Zinn, Macpeak & Seas

[57] ABSTRACT

A rotary position detector for an internal combustion engine with a cam shaft, which includes a sleeve to be mounted on the cam shaft for rotation along with the cam shaft; a hermetic housing to be secured to the engine such that the sleeve rotates within the housing; an optical sensor mounted on an inside of the housing; and a perforated shutter disk secured to the sleeve so as to rotate together with the sleeve with respect to the stationary optical sensor to provide a signal corresponding to a rotary position of the engine.

6 Claims, 4 Drawing Sheets

ROTARY POSITION DETECTOR FOR INTERNAL COMBUSTION ENGINE

BACKGROUND OF THE INVENTION

This invention relates to rotary position detectors for an internal combustion engine, which is capable of detecting a rotary position of an internal combustion engine for controlling the ignition timing.

FIG. 5 shows a conventional rotary position detector for an internal combustion engine such as shown in Japanese U.M. Patent Application Kokai No. 60-23714. This rotary position detector includes a cam timing pulley 1 attached to a cam shaft 2 with a bolt 3. A belt cover 4 covers the entire timing pulley 1. A rotary position sensor 6 is secured to an engine body. A pair of circular ribs 7' and 8' are formed integrally and concentrically with the timing pulley 1. The circular ribs 7' and 8' each have slits so that their passing through the sensor 6 permits the sensor 6 to ouput a signal corresponding to the rotary angle of the cam shaft 2.

To assemble the rotary position detector, the sensor 6 is secured to the engine body and, then, the timing pulley 1 with the circular ribs 7' and 8' is attached to the cam shaft 2. Consequently, the measuring accuracy of the rotary position detector depends upon the combined accuracy of all the associated components and is unable to determine before completion of the assembly. This makes it impossible to give warranty to performance of the rotary position detector itself. Where the timing pulley 1 is dismantled and assembled again due to a defect of another component, the accuracy of the detector can change, thus failing to provide a consistent performance. In addition, dust and dirt can adhere to the sensor of the detector, hindering accurate measurements of the rotary position. Moreover, the detector has been susceptible to electromagnetic noise.

SUMMARY OF THE INVENTION

Accordingly, it is an object of the present invention to provide a rotary position detector for an internal combustion engine, which is able to test its performance independently of other components, thus making possible its shipment from the factory with warranty.

Another object of the invention is to provide a rotary position detector for an internal combustion engine, which is resistant to dust and dirt and electromagnetic noise.

According to the invention there is provided a rotary position detector for an internal combustion engine with a cam shaft, which includes a sleeve to be mounted on the cam shaft for rotation along with the cam shaft; a hermetic housing to be secured to the engine such that the sleeve rotates within the housing; an optical sensor mounted on an inside of the housing; and a perforated shutter disk secured to the sleeve such that it rotates together with the sleeve with respect to the stationary optical sensor to provide a signal corresponding to a rotary position of the engine.

The above and other objects, features, and advantages of the invention will become more apparent from the following description taken in conjunction with the accompanying drawings.

DESCRIPTION OF THE PREFERRED EMBODIMENT

Figure 1:
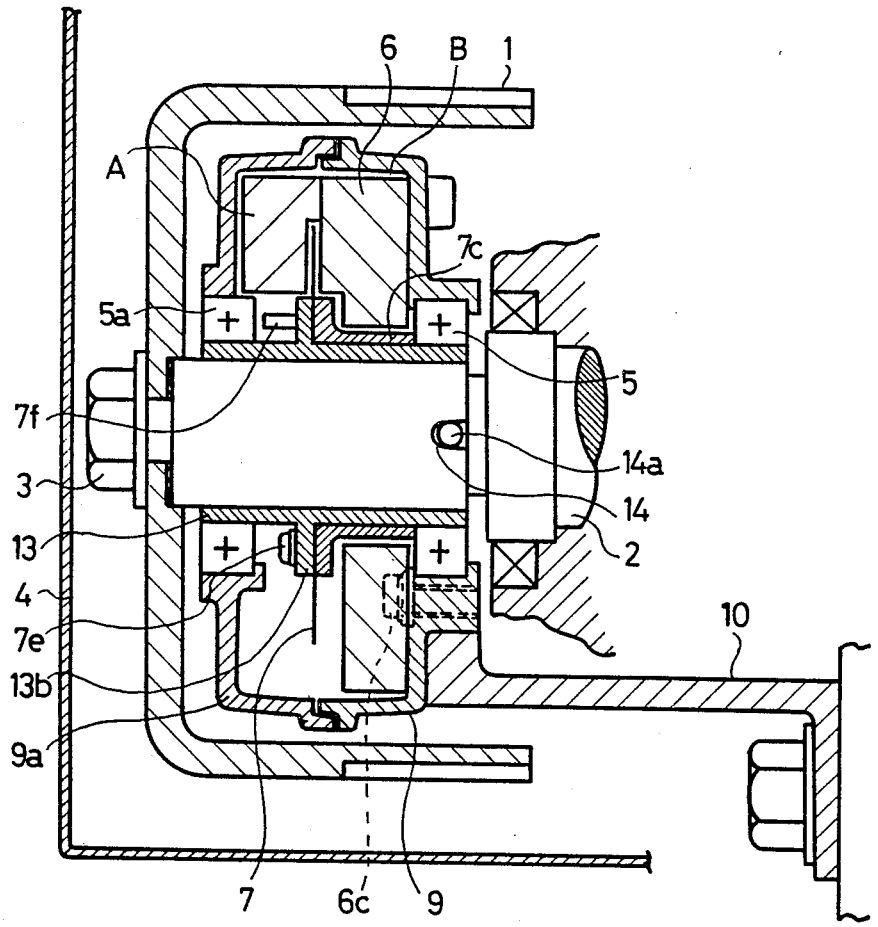
FIG. 1 is a sectional view of a rotary position detector for an internal combustion engine according to an embodiment of the invention.

In FIG. 1, the components 1–4 are identical with those of the conventional detector described above. A hermetic housing section 9 is secured to an engine body via a fixing arm 10. Another housing section **9*a* is joined with the housing section 9 to form a hermetical space. An optical sensor 6 is attached to the housing section 9 with a screw 6*c*. A sleeve 13 is pivotally mounted on the hermetic housing 9 and 9*a* via bearings 5 and 5*a*. A perforated shutter disk 7 is secured to the sleeve 13, which will be described hereinafter in more detail. The sleeve 13 is loosely fitted over the cam shaft 2 and has a notch 14 for receiving a pin 14*a* of the cam shaft 2 so that it rotates along with the cam shaft 2**.

Figure 2:
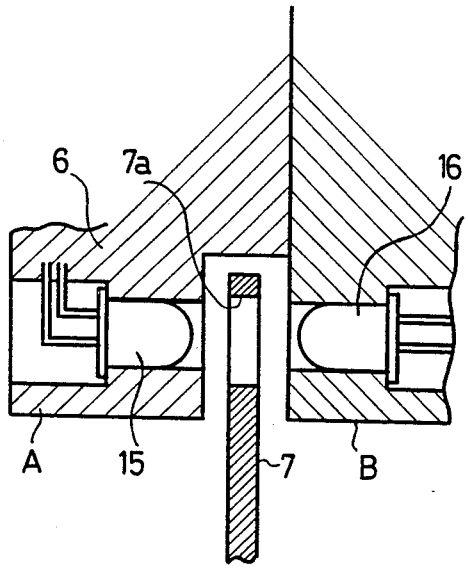
FIG. 2 is a sectional view of part of the rotary position detector for illustrating a spatial relationship between an optical sensor and a shutter disk.

In FIG. 2, a light emitting element 15 and a light receiving element 16 are embedded in the optical sensor 6. When an aperture **7*a* of the shutter disk 7 comes to the optical sensor 6, light passes through from the light emitting element 15 to the light receiving element 16**.

Figure 3:
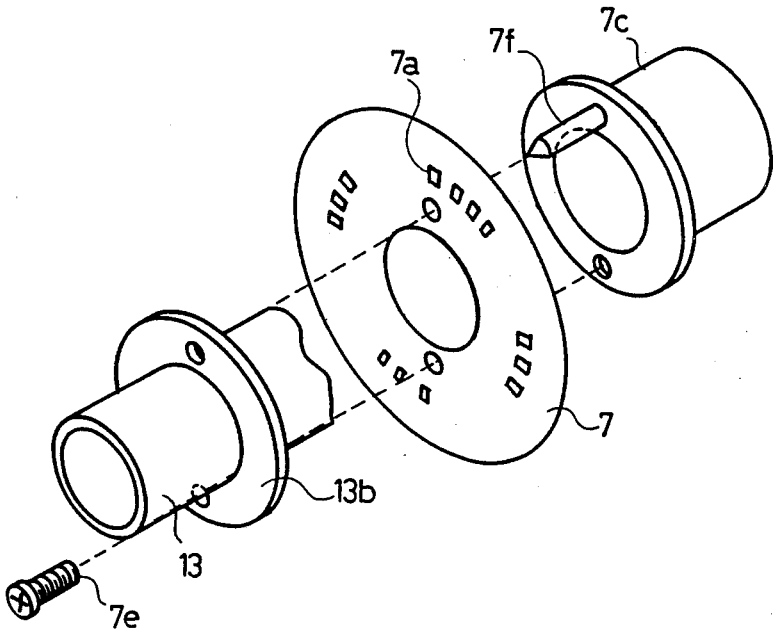
FIG. 3 is an exploded perspective view of the shutter disk and its mount.

In FIG. 3, the shutter disk 7 is secured between a land **13*b* of the sleeve 13 and a spacer 7*c* with a screw 7*e*. A pin 7*f* of the spacer 7*c* passes through openings of the shutter disk 7 and the land 13*b*. A number of apertures 7*a* are provided in the shutter disk 7 so that the optical sensor 6 outputs a rotary position signal as the shutter disk 7** rotates.

Figure 4:
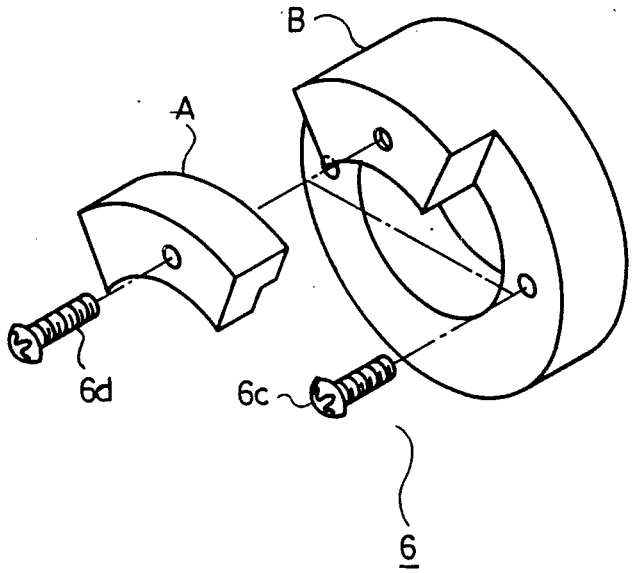
FIG. 4 is an exploded perspective view of the optical sensor.
Figure 5:
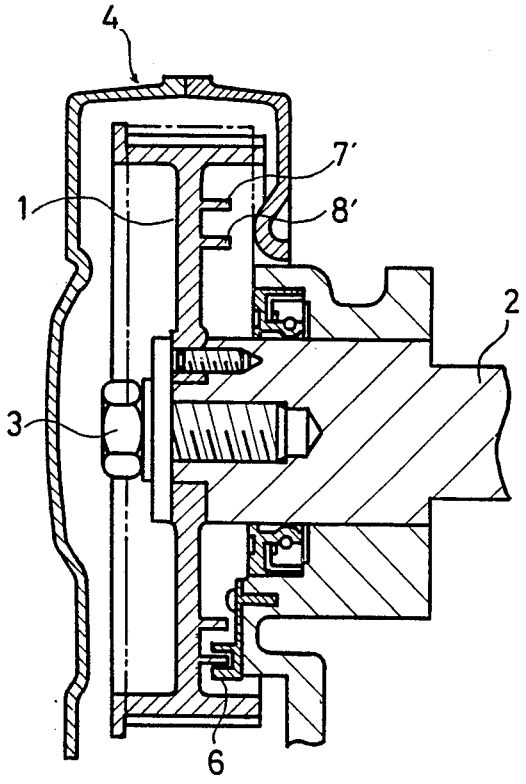
FIG. 5 is a secitonal view of a conventional rotary position detector for an internal combustion engine.

In FIG. 4, the optical sensor 6, which is composed of two sections A and B put together with a screw **6*c*, is secured to the housing section 9 with a pair of screws 6*c***. These two sections A and B each house the light emitting and receiving elements, respectively. The section B also contains electronic circuitry for amplifying a signal from the light receiver element and shaping the waveform.

Alternatively, the hermetic housing section 9 may be mounted such that its rotation is prevented by providing an opening therein through which a support column extending along the cam shaft 2 is passed when the sleeve 13 is mounted on the cam shaft 2.

As has been described above, the rotary position detector is mounted between the cam shaft 2 and the timing pulley 1. Unlike the conventional detector, this detector has the rotary section and the stationary section made integral via the bearings 5 so that it is easy to mount the detector on the cam shaft 2; i.e., before the timing pulley 1 is attached, the rotary section or sleeve 13 may be fitted over the cam shaft 2 and the stationary section or housing 9 may be secured to the engine body via the fixing arm 10 or the like. Of course, it is possible to test performances of the detector before it is mounted on the engine body. In addition, axial vibrations of the cam shaft has no or few adverse effects on the detector because the sleeve 13 engages the cam shaft 2 only in the rotary direction but is free in the axial direction. Moreover, the optical sensor 6 is free of electromagnetic noise such as high voltages of the ignition coil or a leak of magnetism from the coil. The optical sensor 6 and the shutter disk 7 are placed within the hermetical space so that they are free of dust and dirt, too.

As has been described above, according to the invention, a rotary section with a shutter disk which rotates along with the cam shaft and a stationary section with an optical sensor which is secured to an engine body are made integral via bearings so that the measuring accuracy is able to determine before mounting on the cam shaft, thus making it possible to provide factory warranty on shipment. The hermetic housing protects the sensor and the shutter from dust and dirt. The optical sensor is resistant to electromagnetic noise.

While a preferred embodiment of the invention has been described using specific terms, such description is for illustrative purposes only, and it is to be understood that changes and variations may be made without departing from the spirit and scope of the invention as recited in the following claims.

What is claimed is:

1. A rotary position detector for an internal combustion engine with a cam shaft, which comprises:

a sleeve mounted on said cam shaft such that said sleeve rotates along with said cam shaft in a rotary direction but said sleeve is free to move in an axial direction with respect to said cam shaft;

a hermetic housing secured to said engine such that said sleeve rotates within said housing;

an optical sensor mounted inside of said housing; and a perforated shutter disk secured to said sleeve such that it rotates together with said sleeve with respect to said stationary optical sensor to provide a signal corresponding to a rotary position of said engine.

2. The rotary position detector of claim 1, wherein said sleeve and said cam shaft are provided with a notch and a pin, respectively, such that said notch engages said pin to rotate said sleeve along with said cam shaft but allows axial movement of said sleeve with respect to said cam shaft.

3. The rotary position detector of claim 1, wherein said hermetic housing is pivotally mounted on said sleeve via bearings.

4. The rotary position detector of claim 1, wherein said hermetic housing is secured to said engine via a fixing arm.

5. The rotary position detector of claim 1, further comprising a support column extending from said engine body along said cam shaft through an opening of said hermetic housing so as to prevent rotation of said hermetic housing.

6. The rotary position detector of claim 1, wherein said optical sensor comprises a first section disposed on a first side of said perforated shutter disk and housing a light emitting element and a second section disposed on a second side opposite to said first side and housing a light receiving element and electronic circuity for amplifying a signal from said light receiving element and shaping a waveform of said signal.

* * * * *